US006414285B1

(12) United States Patent
Takeda

(10) Patent No.: US 6,414,285 B1
(45) Date of Patent: Jul. 2, 2002

(54) THERMAL PROTECTOR

(75) Inventor: Hideaki Takeda, Misato (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 0 days.

(21) Appl. No.: 09/719,235

(22) PCT Filed: Apr. 14, 2000

(86) PCT No.: PCT/JP00/02438

§ 371 (c)(1),
(2), (4) Date: Dec. 11, 2000

(87) PCT Pub. No.: WO00/63936

PCT Pub. Date: Oct. 26, 2000

(30) Foreign Application Priority Data

Apr. 16, 1999 (JP) ..... 11-109377

(51) Int. Cl.[7] ..... H05B 1/02
(52) U.S. Cl. ..... 219/507; 219/512; 219/491
(58) Field of Search ..... 219/491, 490, 219/510–514, 507; 337/101–114

(56) References Cited

U.S. PATENT DOCUMENTS 4,486,732 A * 12/1984 Wells et al. ..... 337/100
5,048,974 A * 9/1991 Dupuy ..... 337/107
5,268,664 A * 12/1993 Givler ..... 337/112

FOREIGN PATENT DOCUMENTS

| | | |
|---|---|---|
| JP | A5317121 | 12/1993 |
| JP | A620571 | 1/1994 |
| JP | A6119859 | 4/1994 |

* cited by examiner

*Primary Examiner*—Mark Paschall

(57) ABSTRACT

A thermal protector has a fixed plate provided with a fixed contact at the front end portion. There is a first terminal for external connection in the rear end portion and a movable plate having elasticity so that a movable contact provided in the front end portion is brought into contact with the fixed contact by the elasticity. There is a second terminal for external connection connected to the rear end portion of the movable plate; and a bimetal plate, the front end portion being engaged with the movable plate. The movable plate is driven in a direction such that the movable contact is separated from the fixed contact by reversing when a predetermined temperature is exceeded. A part of the movable plate has a double reconstruction provided by folding, and an increase in cross-sectional area due to this double construction substantially decreases the internal resistance.

6 Claims, 8 Drawing Sheets

THERMAL PROTECTOR

This application is the national phase under 35 U.S.C. §371 of PCT International Application No. PCT/JP00/02438 which has an International filing date of Apr. 14, 2000, which designated the United States of America.

TECHNICAL FIELD

The present invention relates to a thermal protector and, more particularly, to a thermal protector suitable to the use for a secondary battery pack incorporated in a portable computer.

BACKGROUND ART

For a secondary battery pack incorporated in a portable computer or the like, a nickel-cadmium battery or a nickel-hydrogen battery has conventionally been used as a secondary battery. In the secondary battery pack using such a secondary battery, a thermal protector of a type such that contacts are opened by utilizing a reversing operation of a bimetal plate is incorporated as a protective means against overheat, overload, short circuit, etc.

The above-described thermal protector has a required internal resistance. The reason for this is that in the event that an excessive current due to overload or short circuit flows, the bimetal plate is reversely operated by self heat generation caused by the internal resistance.

In recent years, the secondary battery has shifted from nickel-cadmium battery or nickel-hydrogen battery to lithium-ion battery. The lithium-ion battery requires exact charge/discharge control. Therefore, the control including protection against short circuit has been accomplished by a control circuit using a semiconductor.

However, in order to further enhance safety, it is desirable to additionally use a safety device of a type. different from the control circuit. For this reason, the battery pack using the lithium battery is also mounted with a thermal protector in many cases.

The thermal protector used for a battery pack incorporating the lithium battery is required to have a low internal resistance in contrast with the conventional thermal protector. Specifically, the thermal protector is required to have a low sensitivity to current, in other words, a current capable of being caused to flow in a state in which the thermal protector is not operated by self heat generation (hereinafter referred to as a non-operating current) is required to be large.

The reason for this is that if the non-operating current is small, when the electrical charge of the lithium battery is released, the thermal protector is operated by self heat generation before the battery is discharged completely, leading to difficulty in the discharge.

On the other hand, the capacity of secondary battery pack tends to increase along with rapid improvement in performance of portable computers in recent years. From this point of view as well, it is desired to increase the non-operating current, that is, to increase a current-carrying capacity.

In order to increase the non-operating current, the internal resistance of the thermal protector has only to be decreased. For this purpose, it can be thought that conductive elements of the thermal protector (a terminal, movable plate, etc.) are made of a low-resistance material. However, there is a limit to a decrease in internal resistance caused by the selection of materials, so that it is necessary to try to make constructional improvement in order to more increase the non-operating current.

The present invention has been made in view of the above situation, and accordingly an object thereof is to decrease the internal resistance to increase the non-operating current.

DISCLOSURE OF THE INVENTION

The present invention provides a thermal protector having a fixed plate provided with a fixed contact in the front end portion and a first terminal for external connection in the rear end portion; a movable plate having elasticity so that a movable contact provided in the front end portion thereof is brought into contact with the fixed contact by the elasticity; a second terminal for external connection connected to the rear end portion of the movable plate; and a bimetal plate, the front end portion thereof being engaged with the movable plate, for driving the movable plate in a direction such that the movable contact is separated from the fixed contact by reversing when a predetermined temperature is exceeded, wherein a part of the movable plate has a double construction provided by folding, and an increase in cross-sectional area due to the double construction substantially decreases the internal resistance.

The double constructed portion is preferably provided in a portion excluding a proximal neck portion of the movable plate.

Also, the present invention provides a thermal protector having a fixed plate provided with a fixed contact in the front end portion and a first terminal for external connection in the rear end portion; a movable plate having elasticity so that a movable contact provided in the front end portion thereof is brought into contact with the fixed contact by the elasticity; a second terminal for external connection connected to the rear end portion of the movable plate; and a bimetal plate, the front end portion thereof being engaged with the movable plate, for driving the movable plate in a direction such that the movable contact is separated from the fixed contact by reversing when a predetermined temperature is exceeded, wherein the rear end portion of the movable plate, the rear end portion of the bimetal plate, and one end portion of the second terminal for external connection are superposed on each other and supported, and the movable plate and the second terminal for external connection are electrically connected to each other in a position close to the movable contact in the superposed support portion to substantially decrease the internal resistance.

Further, the present invention provides a thermal protector having a fixed plate provided with a fixed contact in the front end portion and a first terminal for external connection in the rear end portion; a movable plate having elasticity so that a movable contact provided in the front end portion thereof is brought into contact with the fixed contact by the elasticity; a second terminal for external connection connected to the rear end portion of the movable plate; and a bimetal plate, the front end portion thereof being engaged with the movable plate, for driving the movable plate in a direction such that the movable contact is separated from the fixed contact by reversing when a predetermined temperature is exceeded, wherein the rear end portion of the movable plate and one end portion of the second terminal for external connection are superposed on each other and supported and the rear end portion of the bimetal plate is positioned in front of the superposed support portion, and the movable plate and the second terminal for external connection are electrically connected to each other in a position close to the movable contact in the superposed support portion to substantially decrease the internal resistance.

The movable plate, first terminal for external connection, and second terminal for external connection each are preferably made of a material having an electrical conductivity of 50%IACS and higher. Also, the first and second terminals for external connection each are preferably made of copper.

According to the present invention, the internal resistance is decreased, by which the value of non-operating current can be increased. Therefore, if this thermal protector is applied to a secondary battery pack incorporating a lithium battery, in releasing electrical charge for charging the lithium battery, the electrical charge can be released completely. Also, the resultant increase in current-carrying capacity can accommodate an increase in the capacity of the secondary battery pack.

BEST MODE FOR CARRYING OUT THE INVENTION

Figure 1:
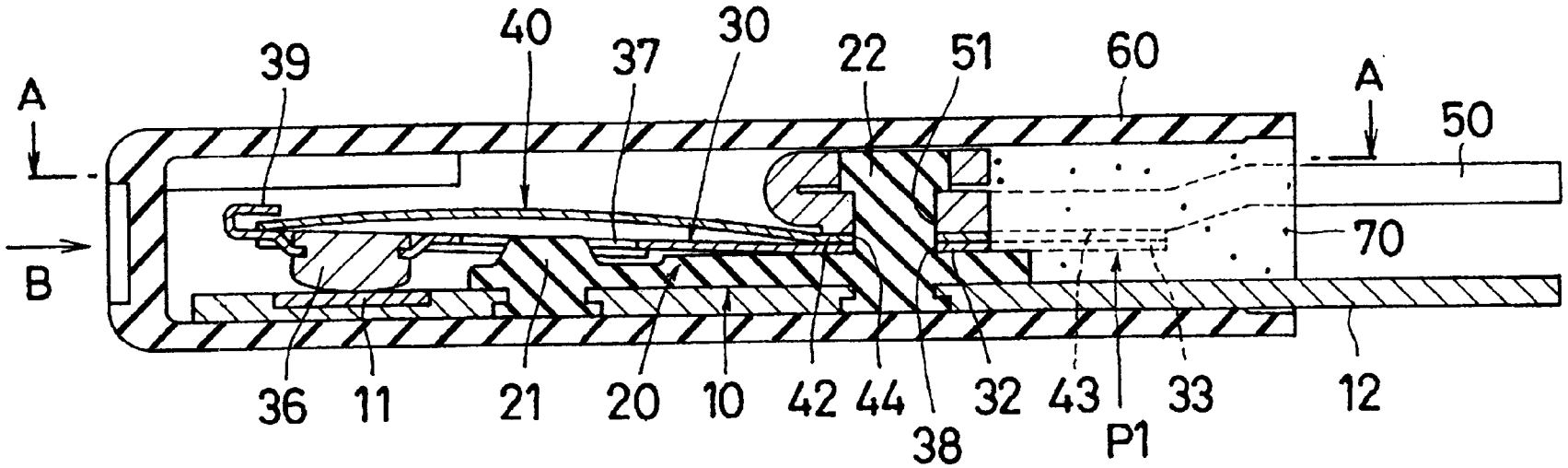
FIG. 1 is a longitudinal sectional view showing an embodiment of a thermal protector in accordance with the present invention.
Figure 2:
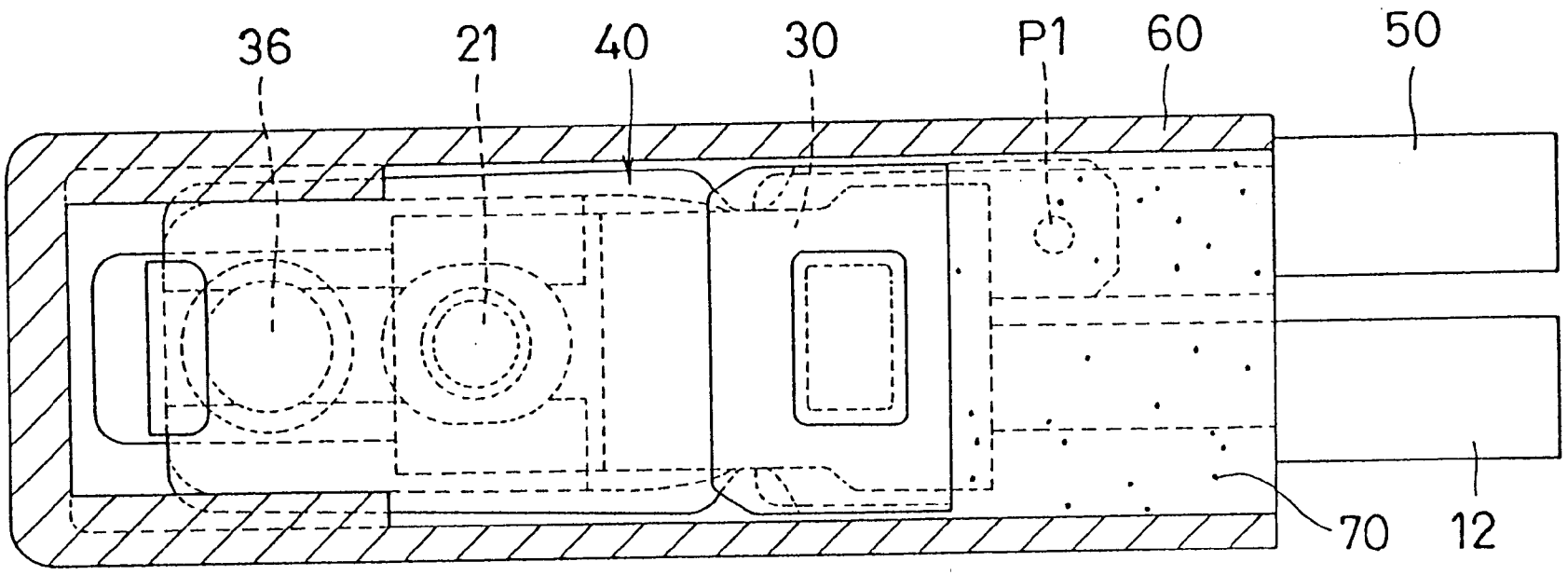
FIG. 2 is a sectional view taken along the line A—A of FIG. 1.
Figure 3:
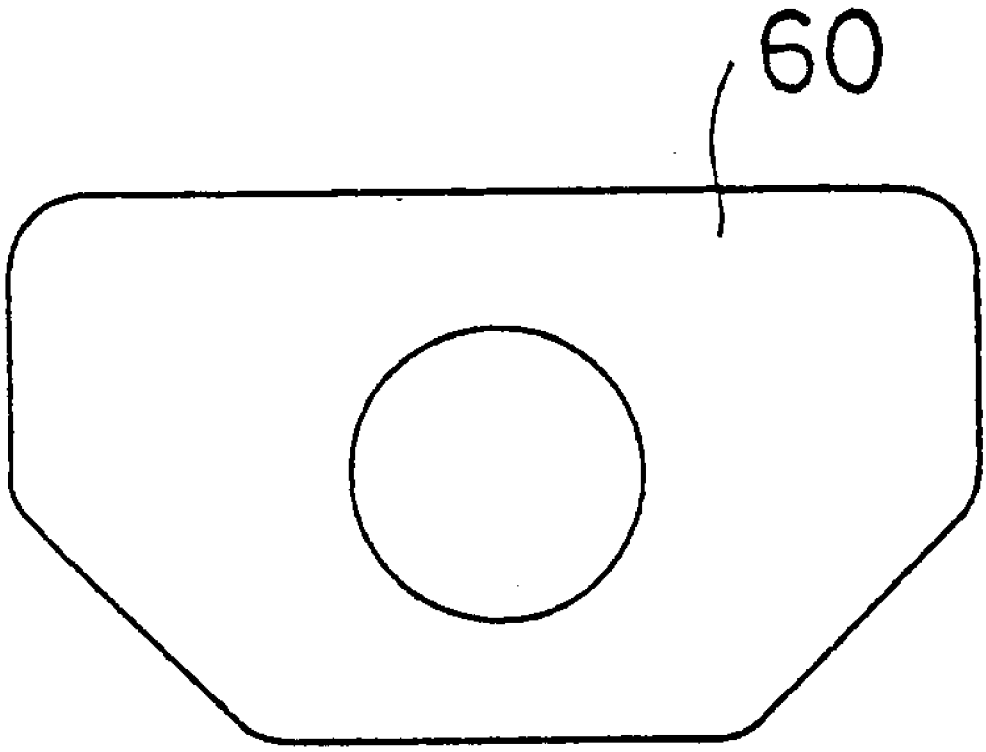
FIG. 3 is a view taken in the direction of the arrow B of FIG. 1.

FIG. 1 is a longitudinal sectional view of a thermal protector in accordance with the present invention. Also, FIG. 2 is a sectional view taken along the line A—A of FIG. 1, and FIG. 3 is a view taken in the direction of the arrow B of FIG. 1.

As shown in FIG. 1, this thermal protector has a construction in which a movable plate 30, a bimetal plate 40, and a second terminal 50 for external connection are disposed in succession on a support block 20 fixed to a fixing plate 10, and these elements are housed in a resin-made casing 60.

The fixing plate 10, which is made of a conductive material, is formed with a fixed contact 11 on one end portion (front end portion). In the other end portion of the fixed plate 10 is formed a first terminal 12 for external connection. The support block 20, which is made of an electrical insulating material, is formed with a convex portion 21 at the front end portion, and also is formed with a column portion 22 at the rear end portion.

Figure 4:
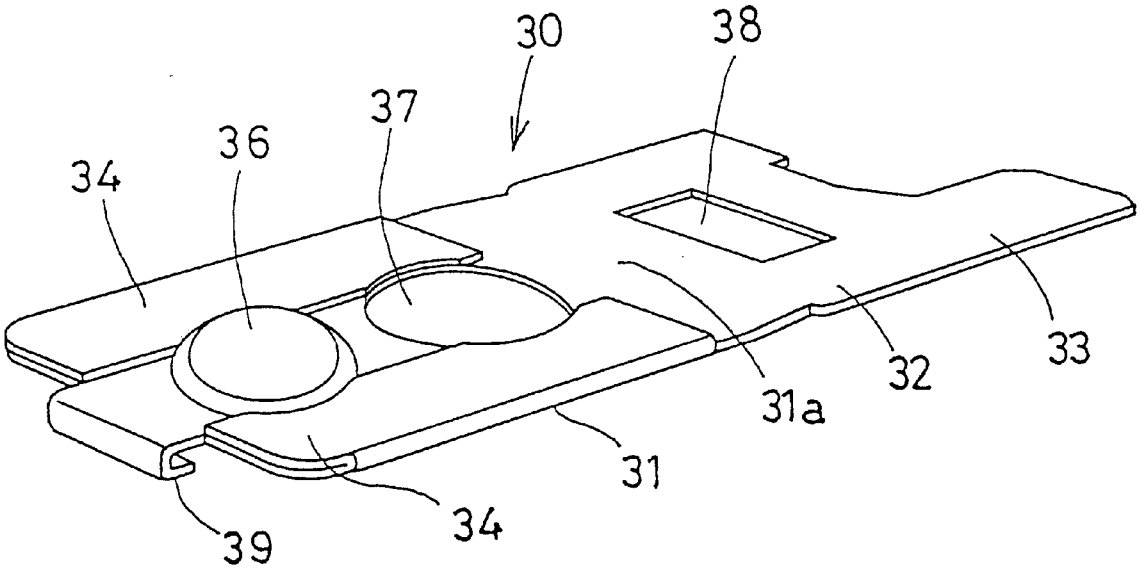
FIG. 4 is a perspective view of a movable plate.

The movable plate 30, which is made of a material having conductivity and elasticity, includes, as shown in FIG. 4, a movable portion 31, a support portion 32 extending from the rear end of the movable portion 31, and a connecting portion 33 projecting from the rear end of the support portion 32.

Figure 5:
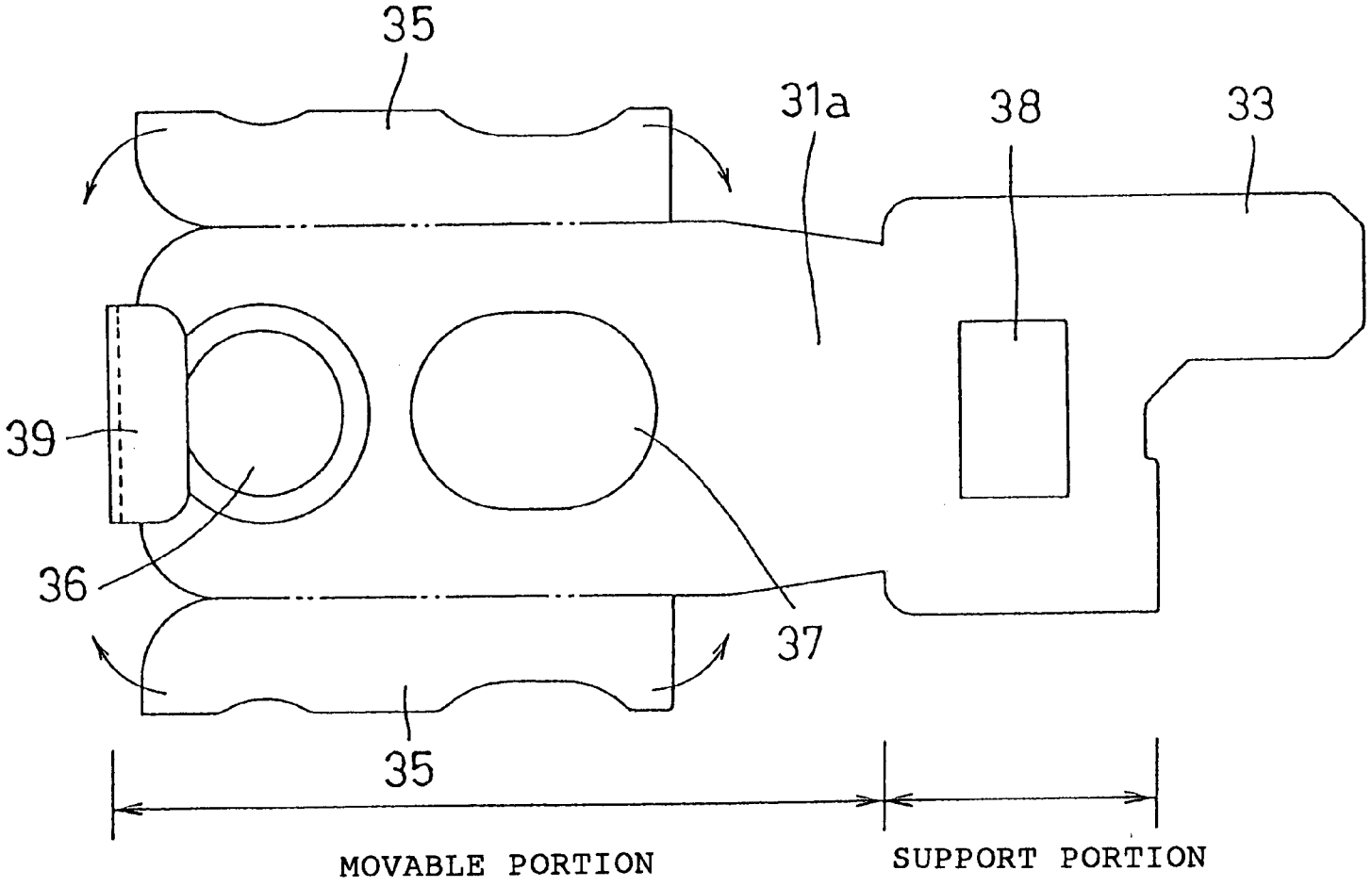
FIG. 5 is a development of a movable plate.

The movable portion 31 of the movable plate 30 has double constructed portions 34 at both sides thereof. The double constructed portion 34 is formed by folding a folded element 35 shown in a development of FIG. 5 in the direction indicated by the arrows (to the lower surface side).

The end portion of the movable portion 31 on the side of the support portion 32, which is a proximal portion thereof, forms a proximal neck portion 31*a* whose width is gradually decreased toward the support portion 32. The double constructed portions 34 are formed in portions excluding the proximal neck portion 31*a*. Therefore, even if the rigidity of the movable portion 31 is increased by the double constructed portions 34, the movable portion 31 can swayingly be moved freely.

On the other hand, the movable portion 31 is provided with a movable contact 36 in the front end portion thereof, and also is formed with a relief hole 37 in a portion located on the support portion side of the movable contact 36. Further, a support hole 38 is formed in the central portion of the support portion 32.

Figure 6:
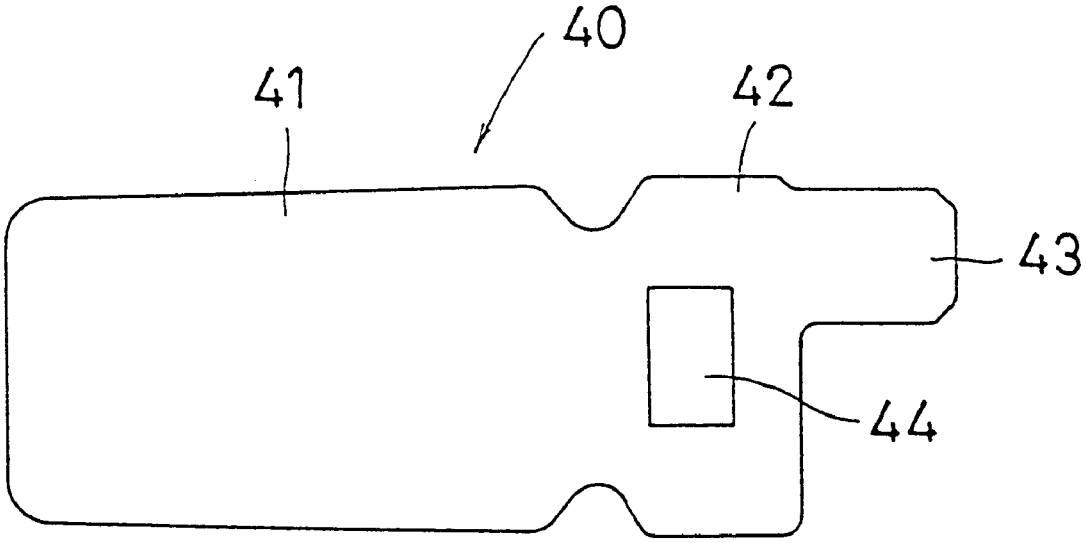
FIG. 6 is a plan view of a bimetal plate.

The bimetal plate 40 includes, as shown in FIG. 6, a reversely operating portion 41, a support portion 42 extending from the rear end of the reversely operating portion 41, and a connecting portion 43 projecting from the rear end of the support portion 42.

The front end portion of the bimetal plate 40 is loosely engaged with an engagement protrusion 39 formed at the front end of the movable plate 30, so that the support portion 42 and the connecting portion 43 thereof are superposed on the support portion 32 and the connecting portion 33 of the movable plate 30, respectively. In the central portion of the support portion 42 is formed a support hole 44 corresponding to the support hole 38 in the movable plate 30.

The front end portion of the second terminal 50 for external connection is bent into a U shape in cross section, and the terminal 50 is disposed so that the lower face of the front end portion thereof is brought into contact with the upper face of the support portion 42 and the connecting portion 43 of the bimetal plate 40. The front end portion of the terminal 50 is formed with a support hole 51.

As shown in FIG. 1, the support holes 38, 44 and 51 of the movable plate 30, the bimetal plate 40, and the terminal 50 for external connection, respectively, engage with the column portion 22 of the support block 20.

The top portion of the support block 22 is fitted to a large-diameter portion of the support hole 51 by thermal deformation. Therefore, the movable plate 30, the bimetal plate 40, and the terminal 50 for external connection are fixedly supported by the column portion 22.

In this state, the movable contact 36 is pressed on the fixed contact 11 by the elasticity of the movable plate 30, and the convex portion 21 of the fixed support block 20 is located in the relief hole 37 in the movable plate 30.

The connecting portion 33 of the movable plate 30 and the connecting portion 43 of the bimetal plate 40 are electrically connected to the second terminal 50 for external connection at point P1 by spot welding or other means. Therefore, in the state shown in FIG. 1 in which the contacts 11 and 36 are touching, the first terminal 12 for external connection and the second terminal 50 for external connection are in conduction through the fixed contact 11, the movable contact 36, the movable plate 30, and the connecting portion 43 of the bimetal plate 40.

The rear end portions of the first terminal 12 and the second terminal 50 project to the outside of the casing 60. Also, an opening of the casing 60 from which the terminals 12 and 50 project is sealed with a resin 70.

When the thermal protector in accordance with this embodiment is incorporated in a battery pack, not shown, for a portable computer, a load current of a secondary battery built into the battery pack flows between the terminals 12 and 50 via the movable plate 30. When the load current is extraordinarily increased by short circuit of load or the like, the movable plate 30 generates heat due to the internal resistance thereof, resulting in a rise in temperature of the bimetal plate 40.

When the temperature of the bimetal plate 40 reaches a predetermined reversing temperature, the reversely operating portion 41 of the bimetal plate 40 operates reversely in an instant, and is deformed into a concave shape. Therefore, the front end of the bimetal plate 40 rises with the convex portion 21 of the support block 20 being a fulcrum. Thereby, the front end portion of the movable plate 30 is raised via the engagement protrusion 39, so that the movable contact 36 separates from the fixed contact 11. As a result, an abnormal load current having flowed between the terminals 12 and 50 is ceased.

As described above, the thermal protector in accordance with the above-described embodiment has the double constructed portions 34 provided at both sides of the movable portion 31 of the movable plate 30, so that the portion 34 has a large cross-sectional area. Therefore, the internal resistance of the movable plate 31 is decreased, by which the electrical resistance between the terminals 12 and 50, that is, the internal resistance of the thermal protector can be decreased substantially.

According to this thermal protector in which the movable plate 30 has a low internal resistance, since the value of non-operating current is large, the sensitivity to current is low. Therefore, if this thermal protector is applied to a secondary battery pack incorporating a lithium battery, in releasing electrical charge for charging the lithium battery, the electrical charge can be released completely. Also, the resultant increase in current-carrying capacity can accommodate an increase in the capacity of the secondary battery pack.

In the thermal protector of the above-described embodiment, the movable plate 30, the bimetal plate 40, and the second terminal 50 for external connection are electrically connected to each other at point P1 shown in FIG. 1. If these elements are connected at point P2 shown in FIG. 7, the electrical resistance between the terminals 12 and 50 can be more decreased for the reasons described below.

Since the above-described connection point P2 is set in a position close to the movable contact 36 in the support portion 42, it is closer to the contact 36 a distance L from the conventional connection point P1. When the movable plate 30 and the terminal 50 are electrically connected to each other at this connection point P2, the length of electrical path in the second terminal 50 is increased by L as compared with the conventional configuration, and on the other hand, the length of electrical path in the movable plate 30 is decreased by L.

Since the thickness (cross-sectional area) of the movable plate 30 is far smaller than the thickness of the second terminal 50, the electrical resistance per unit length of the former is considerably higher than that of the latter. Therefore, if the connection point P2 is set in the above-described position, the electrical path length of the movable plate 30 having a higher electrical resistance is decreased, so that the electrical resistance between the terminals 12 and 50 is substantially decreased.

Means for connecting the movable plate 30 and the terminal 50 to each other at the above-described point P2 is not limited to spot welding. For example, connecting means may be adopted in which the terminal 50 is provided with a protrusion extending toward the movable plate 30 and the movable plate 30 is formed with a hole through which the protrusion passes, and after the protrusion is inserted into the hole, the tip end of protrusion projecting from the hole is pressed to be deformed, by which the movable plate 30 is connected to the terminal 50 by crimping or riveting.

As described above, in the case where the movable plate 30 is connected to the terminal 50 at point P2, the connection at point P1 is unnecessary. However, if the connection is made additionally at point P1, the reliability of connection increases more.

Figure 7:
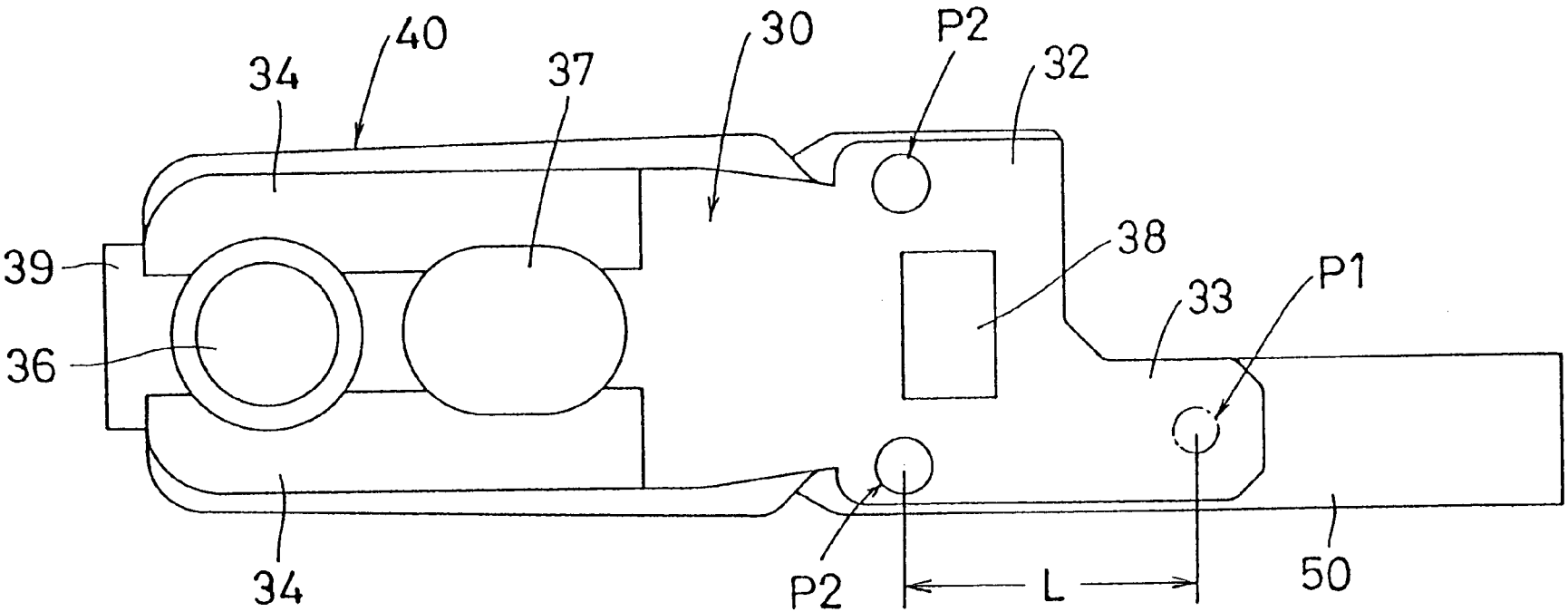
FIG. 7 is a plan view showing a connection position of a movable plate with respect to a second terminal for external connection.

In the embodiment shown in FIG. 7, the movable plate 30 having double constructed portions 34 is used. However, even in a thermal protector using an ordinary movable plate without the double constructed portions 34, the connection of the movable plate to the terminal 50 at point P2 can substantially decrease the internal resistance thereof.

Figure 8:
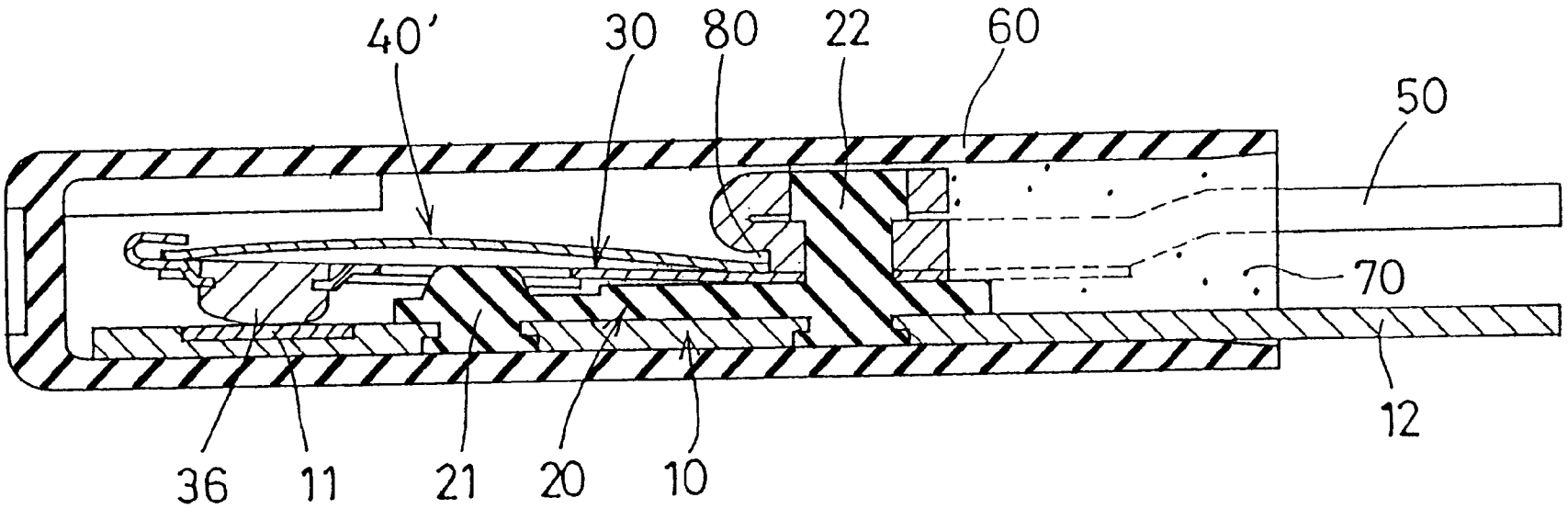
FIG. 8 is a longitudinal sectional view showing another embodiment in accordance with the present invention.

In the embodiment shown in FIG. 1, the bimetal plate 40 having a shape shown in FIG. 6 is used, and the support portion 42 and the connecting portion 43 of the bimetal plate 40 are held between the movable plate 30 and the terminal 50. However, a bimetal plate 40' without the support portion 42 and the connecting portion 43, as shown in FIG. 8, can be used. In this case, the rear end portion of the bimetal plate 40' is inserted in a gap 80 formed by the bent portion of the terminal 50 and the movable plate 30.

Although the electrical resistance between the terminals 12 and 50 is decreased by improvement in construction, this electrical resistance also depends on the materials of the conductive members. Therefore, the materials of the conductive members will now be explained.

In the conventional thermal protector, the conductive members of movable plate, fixed plate, terminal, etc. each are made of a material of about 20%IACS (for example, brass) to provide a required internal resistance to the conductive members. IACS is an acronym for International Annealed Copper Standard. Also, %IACS means a percentage ratio of electrical conductivity in respect to a standard annealed copper wire.

On the other hand, in the thermal protector in accordance with the present invention, the movable plate 30 is made of a material of 50%IACS and higher (for example, beryllium copper 11 alloy), and also the fixed plate 10, the first terminal 12 for external connection, and the second terminal 50 for external connection each are made of copper having a conductivity of 98%IACS and higher.

The conductive members made of such a material, coupled with the above-described improvement in construction, can greatly decrease the electrical resistance between the terminals 12 and 50. Specifically, in the case where the conductive members of the thermal protector shown in FIG. 1 or FIG. 7 are made of the above-described material, the electrical resistance between the terminals 12 and 50 can be decreased down to 2 mΩ and lower.

The above-described decrease in electrical resistance brings about an increase in the aforementioned non-operating current. For the thermal protector shown in FIG. 1 or FIG. 7, the non-operating current at 60° C. increases up to 10 A and larger.

INDUSTRIAL APPLICABILITY

In the thermal protector in accordance with the present invention, since the value of non-operating current is large, the sensitivity to current is low. Therefore, if this thermal protector is applied to a secondary battery pack incorporating a lithium battery, in releasing electrical charge for charging the lithium battery, the electrical charge can be released completely. Also, the resultant increase in current-carrying capacity can accommodate an increase in the capacity of the secondary battery pack.

What is claimed is:

1. A thermal protector comprising:

a fixed plate provided with a fixed contact in the front end portion and a first terminal for external connection in the rear end portion;

a movable plate having elasticity so,that a movable contact provided in the front end portion thereof is brought into contact with said fixed contact by the elasticity;

a second terminal for external connection connected to the rear end portion of said movable plate; and a bimetal plate, the front end portion thereof being engaged with said movable plate, for driving said movable plate in a direction such that said movable contact is separated from said fixed contact by reversing when a predetermined temperature is exceeded, wherein a part of said movable plate has a double construction provided by folding, and an increase in cross-sectional area due to said double construction substantially decreases the internal resistance.

2. The thermal protector according to claim 1, wherein said double constructed portion is provided in a portion excluding a proximal neck portion of said movable plate.

3. A thermal protector comprising:

a fixed plate provided with a fixed contact in the front end portion and a first terminal for external connection in the rear end portion;

a movable plate having elasticity so that a movable contact provided in the front end portion thereof is brought into contact with said fixed contact by the elasticity;

a second terminal for external connection connected to the rear end portion of said movable plate; and a bimetal plate, the front end portion thereof being engaged with said movable plate, for driving said movable plate in a direction such that said movable contact is separated from said fixed contact by reversing when a predetermined temperature is exceeded, wherein the rear end portion of said movable plate, the rear end portion of said bimetal plate, and one end portion of said second terminal for external connection are superposed on each other and supported, and said movable plate and said second terminal for external connection are electrically connected to each other in a position close to said movable contact in the superposed support portion to substantially decrease the internal resistance.

4. A thermal protector comprising:

a fixed plate provided with a fixed contact in the front end portion and a first terminal for external connection in the rear end portion;

a movable plate having elasticity so that a movable contact provided in the front end portion thereof is brought into contact with said fixed contact by the elasticity;

a second terminal for external connection connected to the rear end portion of said movable plate; and a bimetal plate, the front end portion thereof being engaged with said movable plate, for driving said movable plate in a direction such that said movable contact is separated from said fixed contact by reversing when a predetermined temperature is exceeded, wherein the rear end portion of said movable plate and one end portion of said second terminal for external connection are superposed on each other and supported and the rear end portion of said bimetal plate is positioned in front of the superposed support portion, and said movable plate and said second terminal for external connection are electrically connected to each other in a position close to said movable contact in said superposed support portion to substantially decrease the internal resistance.

5. The thermal protector according to any one of claims 1, 3 and 4, wherein said movable plate, first terminal for external connection, and second terminal for external connection each are made of a material having an electrical conductivity of 50%IACS and higher.

6. The thermal protector according to any one of claims 1, 3, 4 and 5, wherein said first and second terminals for external connection each are made of copper.

* * * * *